US010180043B2

(12) United States Patent
Myhre et al.

(10) Patent No.: US 10,180,043 B2
(45) **Date of Patent: *Jan. 15, 2019**

(54) METHOD FOR ESTABLISHMENT OF A NEW WELL PATH FROM AN EXISTING WELL

(71) Applicant: Hydra Systems AS, Tananger (NO)

(72) Inventors: Morten Myhre, Tananger (NO); Arne Gunnar Larsen, Sandnes (NO); Roy Inge Jensen, Stavanger (NO); Patrick Andersen, Hafrsfjord (NO); Arnt Olav Dahl, Randaberg (NO); Erlend Engelsgjerd, Tananger (NO); Markus Iuell, Tananger (NO); Arnold Østvold, Stavanger (NO)

(73) Assignee: Hydra Systems AS, Tananger (NO)

( * ) Notice: Subject to any disclaimer, the term of this patent is extended or adjusted under 35 U.S.C. 154(b) by 420 days.

This patent is subject to a terminal disclaimer.

(21) Appl. No.: 14/910,885

(22) PCT Filed: Aug. 12, 2014

(86) PCT No.: PCT/NO2014/050145
§ 371 (c)(1),
(2) Date: Feb. 8, 2016

(87) PCT Pub. No.: WO2015/023190
PCT Pub. Date: Feb. 19, 2015

(65) Prior Publication Data

US 2016/0194937 A1 Jul. 7, 2016

(30) Foreign Application Priority Data

Aug. 16, 2013 (NO) ..... 20131123

(51) Int. Cl.
*E21B 37/00* (2006.01)
*E21B 7/06* (2006.01)
(Continued)

(52) U.S. Cl.
CPC ..... *E21B 37/00* (2013.01); *E21B 7/061* (2013.01); *E21B 33/12* (2013.01);
(Continued)

(58) Field of Classification Search
CPC ..... E21B 37/00; E21B 7/061; E21B 33/12; E21B 33/1204; E21B 33/13; E21B 33/16; E21B 37/08; E21B 43/11; E21B 43/116
See application file for complete search history.

(56) References Cited

U.S. PATENT DOCUMENTS 5,423,387 A 6/1995 Lynde
7,168,491 B2 * 1/2007 Malone ..... E21B 7/061 166/298
(Continued)

FOREIGN PATENT DOCUMENTS

AU 2012211550 8/2013
EP 2006486 12/2008
(Continued)

OTHER PUBLICATIONS

International Search Report for PCT/NO2014/050145 dated Dec. 11, 2014.
(Continued)

*Primary Examiner* — Zakiya W Bates
*Assistant Examiner* — Crystal J Miller
(74) *Attorney, Agent, or Firm* — Andrus Intellectual Property Law, LLP

(57) ABSTRACT

A method is for establishment of a new well path from a well. The method comprises disposing and anchoring a plug base in a casing in the well; lowering a perforation tool into the casing; forming holes in the casing along a longitudinal section; pumping a flushing fluid out through outlets in a flushing tool and into the casing and further out into an annulus; pumping a fluidized plugging material out through
(Continued)

the flushing tool and into the casing and further out into the annulus; placing the fluidized plugging material along the longitudinal section so as to form a plug across a cross section of the well; wherein the outlets in the flushing tool are angled non-perpendicularly relative to a longitudinal axis of the flushing tool. The method also comprises removing a portion of the plug until a cross-sectional section of the plug remains in the annulus; disposing and anchoring a direction-guiding element in the casing within the longitudinal section; by means of the element, guiding a drilling tool against the inside of the casing; and forming an exit hole through the casing and the cross-sectional section of the plug, thereby allowing a new well path to be formed from the well.

25 Claims, 9 Drawing Sheets

(51) Int. Cl.

| | |
|---|---|
| ***E21B 33/12*** | (2006.01) |
| ***E21B 33/16*** | (2006.01) |
| ***E21B 43/11*** | (2006.01) |
| ***E21B 33/13*** | (2006.01) |
| ***E21B 37/08*** | (2006.01) |
| ***E21B 43/116*** | (2006.01) |

(52) U.S. Cl.
CPC ..... *E21B 33/1204* (2013.01); *E21B 33/13* (2013.01); *E21B 33/16* (2013.01); *E21B 37/08* (2013.01); *E21B 43/11* (2013.01); *E21B 43/116* (2013.01)

(56) References Cited

U.S. PATENT DOCUMENTS

| | | | | |
|---|---|---|---|---|
| 8,312,921 | B2 * | 11/2012 | Gambier | E21B 33/127 166/179 |
| 9,010,425 | B2 * | 4/2015 | Larsen | E21B 33/13 166/285 |
| 9,670,730 | B2 * | 6/2017 | Larsen | E21B 33/14 |
| 2002/0023754 | A1 | 2/2002 | Byuaert | |
| 2002/0162657 | A1 | 11/2002 | Tumlin | |
| 2004/0244992 | A1 | 12/2004 | Carter et al. | |
| 2005/0061503 | A1 | 3/2005 | Misselbrook et al. | |
| 2006/0076137 | A1 * | 4/2006 | Malone | E21B 7/061 166/298 |
| 2009/0014177 | A1 * | 1/2009 | Hilleary | E21B 33/14 166/285 |
| 2010/0025036 | A1 * | 2/2010 | Gambier | E21B 33/127 166/277 |
| 2013/0312963 | A1 * | 11/2013 | Larsen | E21B 33/13 166/285 |
| 2016/0201430 | A1 * | 7/2016 | Larsen | E21B 33/13 166/285 |

FOREIGN PATENT DOCUMENTS

| | | |
|---|---|---|
| NO | 20120099 | 9/2012 |
| WO | 0125594 | 4/2001 |
| WO | 02081861 | 10/2002 |
| WO | 2012096580 | 7/2012 |
| WO | 2012128644 | 9/2012 |
| WO | 2013115652 | 8/2013 |
| WO | 2013122480 | 8/2013 |
| WO | 2013133719 | 9/2013 |

OTHER PUBLICATIONS

Written Opinion for PCT/NO2014/050145 dated Dec. 11, 2014.
International Preliminary Report on Patentability, PCT/NO2014/050145, dated Feb. 16, 2016.

Supplementary European Seach Report, EP Application No. 14836487, date of completion Apr. 4, 2017.

* cited by examiner

METHOD FOR ESTABLISHMENT OF A NEW WELL PATH FROM AN EXISTING WELL

CROSS-REFERENCE TO RELATED APPLICATIONS

This application is the U.S. national stage application of International Application PCT/NO2014/050145, filed Aug. 12, 2014, which international application was published on Feb. 19, 2015, as International Publication WO2015/023190 in the English language. The international application is incorporated herein by reference, in entirety. The international application claims priority to Norwegian Patent Application No. 20131123, filed Aug. 16, 2013, which is incorporated herein by reference, in entirety.

FIELD

The invention concerns a method for establishment of a new well path from an existing well. More specifically, the invention concerns a method providing mechanical stability in the form of a well plug around the entry of the new well path being formed through an existing casing.

BACKGROUND

It is known to form a new well path, sidetrack, from an existing well by drilling a new well path out through the wall of a casing. This is carried out by anchoring a whipstock at a desired location in the well, whereby a drilling body, which subsequently engages the whipstock, changes direction and drills through a sidewall of the casing from the inside of the casing. Oftentimes, such a drilling operation results in an oblong opening, generally referred to as a window, in the wall of the casing. It may also be of interest, in some cases, to drill a new well path out through a window through several casing sizes disposed in a pipe-in-pipe assembly in a well. Most commonly, such a sidetrack is formed at a relatively shallow level in a well, and far away from the reservoir, so as to reasonably ensure that the casing, which is to be drilled through, is cemented to a surrounding formation, whereby the window is anchored well and becomes sufficiently stable. By so doing, no great danger exists of allowing the window portion to move during formation thereof, or during subsequent operations, for example when the drill string is being pulled back through the window. Given that the sidetrack usually is formed at a relatively shallow level in the well, the new well path oftentimes becomes very long, which incurs large costs to an operator. It would therefore have been advantageous, in many cases, if such a sidetrack could have been carried out at a deeper level in the well. At such deeper-lying locations, the/those particular casing(s), which is/are to be drilled through for the sidetrack, oftentimes is/are insufficiently cemented to the surrounding formation, and/or to each other when using several casing sizes. The cement may also have insufficient quality and/or be completely or partially absent. It may therefore be difficult, in such situations, to achieve a sufficiently good anchoring and stability of casings in order to carry out an unproblematic sidetrack operation.

Independent of how deep the particular sidetrack location is located in a well, it would have been useful if the/those particular casing(s), which is/are located at this location, and which are to be drilled through to form a window for the sidetrack, could be anchored and stabilized to a sufficient degree prior to initiating the sidetrack operation. In order to carry out such a sidetrack, it is not desirable, in this context, to remove a complete longitudinal section of the/those particular casing(s), so-called section milling, at the location of the sidetrack in the well. Besides weakening the integrity of the well by removing a complete longitudinal section of the/those particular casing(s), such a section milling is very time-consuming and costly. Moreover, such operations are encumbered with various challenges in the area of health, safety and environment (HSE).

SUMMARY

The object of the invention is to remedy or to reduce at least one of the disadvantages of the prior art, or at least to provide a useful alternative to the prior art.

The object is achieved by virtue of features disclosed in the following description and in the subsequent claims.

The invention concerns a method for establishment of a new well path from an existing well, wherein the existing well, at least in a portion where the new well path is to be established, is defined radially by at least one casing, wherein the method comprises the following steps:

(A) disposing and anchoring a plug base in an innermost casing in the well;

(B) lowering a perforation tool into the innermost casing, and onto a longitudinal section L1 of the well located above the plug base;

(C) by means of the perforation tool, forming holes in the at least one casing along the longitudinal section L1 of the well;

(D) by means of a flushing tool attached to a lower portion of a flow-through pipe string, and lowered into the innermost casing onto the longitudinal section pumping a flushing fluid down through the pipe string, out through at least one flow-through outlet in the flushing tool, into the innermost casing and further out, via holes in the at least one casing, into at least one annulus located outside the innermost casing, thereby cleaning the at least one annulus;

(E) pumping a fluidized plugging material down through the pipe string and out through the flushing tool, into the innermost casing and further out into the at least one annulus via holes in the at least one casing;

(F) placing the fluidized plugging material above the plug base, and along the longitudinal section L1 of the well, after which the plugging material forms a plug covering substantially a complete cross section T1 of the well.

The distinctive characteristic of the method is that at least one of the at least one outlet in the flushing tool is angled non-perpendicularly relative to a longitudinal axis of the flushing tool, whereby a corresponding discharge jet from the flushing tool also will be non-perpendicular to the longitudinal axis of the flushing tool; and wherein the method also comprises the following steps:

(G) removing a portion of the plug in such a manner that at least a cross-sectional section T3 of the plug remains in the at least one annulus at the outside of the at least one casing;

(H) disposing and anchoring a direction-guiding element in the innermost casing, and at least partially within the longitudinal section L1 of the well;

(I) by means of the direction-guiding element, guiding a drilling tool against the inside of the innermost casing, and in direction of the new well path to be established; and (J) by means of the drilling tool, and within the longitudinal section L1, forming an exit hole through the at least one casing and the cross-sectional section T3 of the plug, thereby opening up to subsequent formation of said new well path exiting from the well.

The preceding flushing and cleaning of the at least one annulus outside the innermost casing ensures good filling and good adhesion of the subsequent plugging material in said annulus, whereas the remaining cross-sectional section T3 of the plug in the at least one annulus ensures that the well is provided with a good base around the exit hole through the at least one casing from which the new well path is to exit. By so doing, a good anchoring and stabilization of the at least one casing is ensured before initiating a sidetrack operation. Using section milling as an introductory step prior to such a sidetrack operation is therefore not required. By so doing, said disadvantages typically associated with such section milling are also avoided.

The plug base, which is disposed and anchored in the innermost casing in the well, may comprise a packer element of a type known per se forming a base for the subsequent plugging with the fluidized plugging material.

In one embodiment of the present method, the at least one casing may comprise only the innermost casing. Only one annulus will then be present between the outside of the casing and a surrounding formation.

In another embodiment of the present method, the at least one casing may comprise a pipe-in-pipe assembly composed of at least two casing sizes, wherein the innermost casing constitutes the smallest casing size in the pipe-in-pipe assembly. The casing size is given by the diameter of the particular casing. As such, the pipe-in-pipe assembly may comprise, for example, two, three, and even four, casing sizes placed successively within the largest casing size, where the smallest casing size constitutes said innermost casing. These are quite ordinary pipe constellations in subterranean wells. Outside the innermost casing, one or more annulus/annuli may therefore be present between various casing sizes, and also an outer annulus present between the largest casing size, i.e. the outermost casing, and a surrounding formation.

The flushing tool may also comprise a first section for discharge of the flushing fluid, and a second section for discharge of the fluidized plugging material. Thereby, the first section may be arranged with an optimum configuration and size of outlets for optimum discharge of the flushing fluid, whereas the second section may be arranged with an optimum configuration and size of outlets for optimum discharge of the fluidized plugging material. In order to avoid potential setting and plugging of plugging material, outlets for the plugging material possibly may be larger than the outlets for the flushing fluid.

Further, the flushing tool may be formed with several outlets, wherein the outlets are angled within ±80° of a plane being perpendicular to the longitudinal axis of the flushing tool, whereby the discharge jets from the longitudinal axis of the flushing tool also are distributed within ±80° of said plane. This will prove particularly appropriate with respect to cleaning of said at least one annulus given then that it will be easier for the flushing fluid, having such angled discharge jets, to gain access to various places in said annulus, thus achieving an optimum flushing and cleaning effect in the annulus.

In this context, at least one of the at least one outlet in the flushing tool may be provided with a nozzle, for example a nozzle of a suitable size and/or shape. Thereby, several outlets in the flushing tool possibly may be of a particular size, whereas nozzles in the outlets may have different sizes and/or shapes, whereby the discharge jets from the nozzles may be different. By so doing, it is also easy to modify the flushing tool and its associated flushing effect in order to achieve the desired effect.

Yet further, step (D) of the method, i.e. the flushing step, may comprise rotating the pipe string whilst flushing, and/or moving the pipe string in a reciprocating motion whilst flushing. This may provide a very thorough cleaning on the inside and outside of the at least one casing at the particular places in the well.

Before step (D), the method may also comprise adding an abrasive agent to the flushing fluid. Such an abrasive agent may comprise small particles of particulate mass, for example sand particles. Use of an abrasive agent in the flushing fluid may prove particularly appropriate if the at least one annulus outside the innermost casing is completely or partially filled with, for example, cement residues, formation particles, precipitated drilling mud components and/or other casting materials or fluids. Such material may prove difficult to remove without abrasive agents present in the flushing fluid.

According to the method, an abrasive agent may thus be added to the flushing fluid in an amount corresponding to between 0.05 weight percent and 1.00 weight percent. In a particularly preferred embodiment, circa 0.1 weight percent of an abrasive agent, for example sand, may be added to the flushing fluid.

In a further embodiment of the method, the flushing fluid may be discharged from the at least one outlet of the flushing tool at a discharge velocity of at least 15 meters per second. Tests show that 15 meters per second is a limit value above which the flushing tool is able to clean sufficiently.

It is more advantageous for the flushing fluid to be discharged from the at least one outlet of the flushing tool at a discharge velocity of at least 50 meters per second. Said tests also have shown that the flushing is particularly effective when the flushing fluid has a discharge velocity of at least 50 meters per second.

Further, the flushing fluid possibly may be discharged from the at least one outlet of the flushing tool as a substantially rotation-free discharge jet. The advantage thereof is that there is no need for nozzles that possibly may provide a rotational effect to the discharge jet, insofar as such nozzles usually require more space for support.

Moreover, the fluidized plugging material may comprise cement slurry, which constitutes the most common plugging material in most wells.

As an alternative or addition, the fluidized plugging material may comprise a fluidized particulate mass. A somewhat different use of a fluidized particulate mass in a well is described, among other places, in WO 01/25594 A1 and in WO 02/081861 A1.

Furthermore, the flushing fluid may comprise drilling mud. This will be a suitable flushing fluid given that drilling mud usually is readily available and also functions as a pressure barrier in a well.

Yet further, a displacement body may be used in the method to further displace and distribute the fluidized plugging material in the innermost casing and further out into the at least one annulus. Such a displacement body is shown and described, among other places, in Norwegian patent application No. 20120099 entitled "Apparatus and method for positioning of a fluidized plugging material in an oil well or gas well", which corresponds to international publication WO 2012/128644 A2.

In a further embodiment, the method may also comprise, before step (B), the following steps:

connecting the perforation tool and the flushing tool into an assembly thereof; and connecting the assembly to said lower portion of the pipe string;

thereby carrying out the perforation steps (B, C) and the flushing step (D) in one and the same trip down into the well.

Obviously, this embodiment of the method saves on time and cost, which is of particularly great significance for well operations offshore.

In this context, a lower end portion of the flushing tool possibly may be releasably connected to the perforation tool; and wherein the perforation tool is separated from the flushing tool and is left in the well after step (C).

This may prove particularly appropriate provided it is possible to leave the perforation tool in the well.

In an alternative embodiment, the method may also comprise, before step (D), the following steps:

lowering the perforation tool into the innermost casing and forming said holes in the at least one casing along the longitudinal section L1 of the well;

pulling the perforation tool out of the well; and attaching the flushing tool to the lower portion of the pipe string for subsequent execution of steps (D)-(F);

thereby carrying out the perforation steps (B, C) and the flushing step (D) in separate trips down into the well.

Such an embodiment of the method may prove necessary provided it is not possible to leave the perforation tool in the well, for example due to lack of space in the innermost casing.

Further, step (G) of the method may comprise removing a portion of the plug in the innermost casing, and in such a manner that a longitudinal section L3 of the plug still remains centrally in the well and within the innermost casing.

Advantageously, this allows the longitudinal section L3 of the plug to be used as a base for various tools and equipment desired to be placed permanently or temporarily in the well, for example a direction-guiding element in the form of a whipstock or similar.

Possibly, said longitudinal section L3 remaining centrally in the well may constitute less than half of the original length of the plug.

Yet further, step (G) of the method may comprise removing the portion of the plug by means of drilling.

Moreover, the method may further comprise, after step (3), drilling out the new well path from the exit hole through the at least one casing in the well.

BRIEF DESCRIPTION OF THE DRAWINGS

Hereinafter, an exemplary embodiment of the method is described and depicted in the accompanying drawings, where.

DETAILED DESCRIPTION OF THE DRAWINGS

Figure 1:
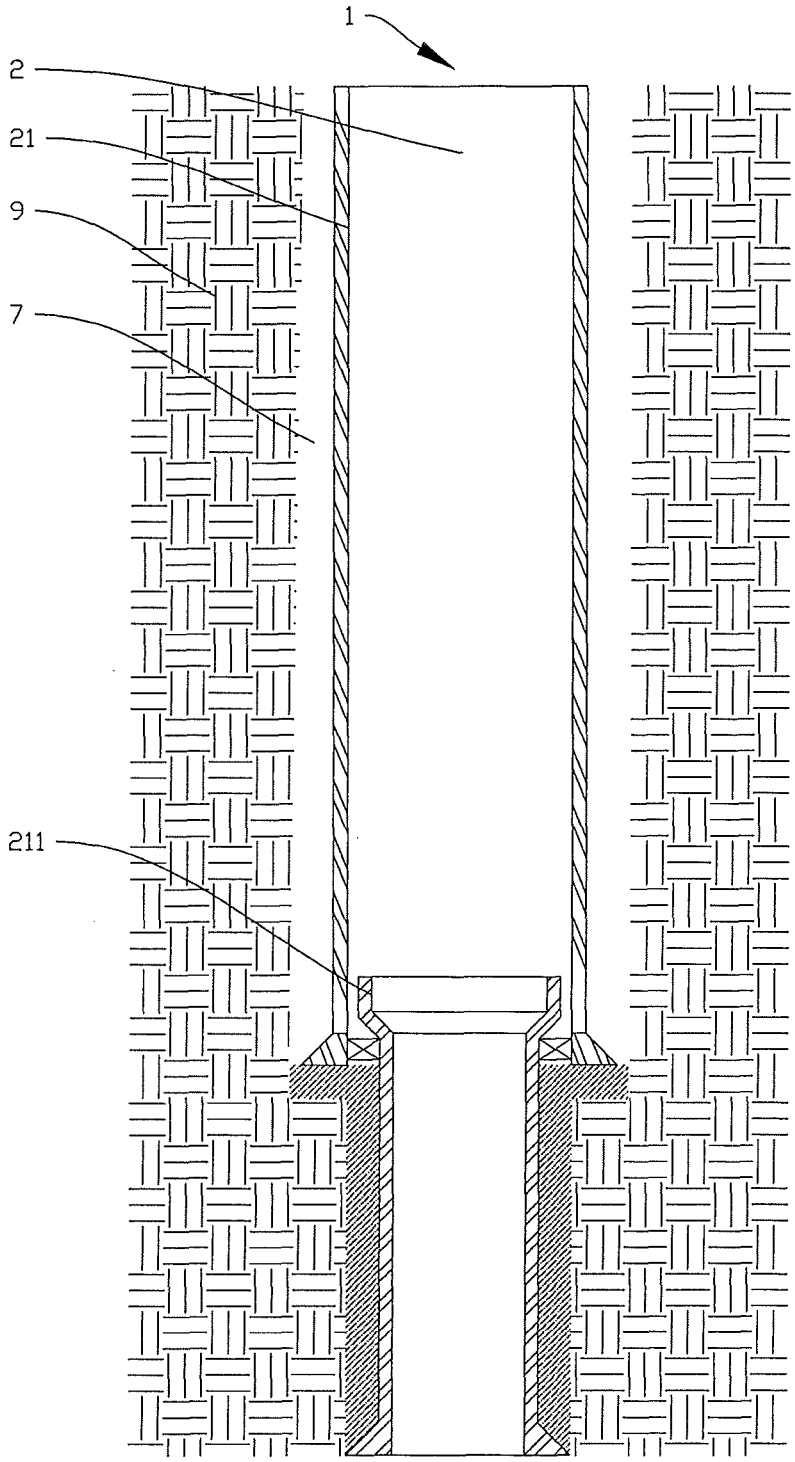
FIG. 1 shows a simplified, schematic vertical section through a well.

The Figures are schematic and merely show steps, details and equipment being essential to the understanding of the invention. Further, the Figures are distorted with respect to relative dimensions of elements and details shown in the Figures. The Figures are also somewhat simplified with respect to the shape and richness of detail of such elements and details. Elements not being central to the invention may also have been omitted from the Figures.

Hereinafter, reference numeral 1 denotes a well within which the present method is used. The well 1 is also depicted in a simplified and schematic manner.

FIG. 1 shows the well 1 with an existing well path 2 provided with a casing 21 in an upper portion of the well 1. Hereinafter, the casing 21 is termed an innermost casing; cf. the preceding discussion thereof. The well 1 is also provided with a liner 211 extending from a lower portion of the casing 21 and further down into the well 1 along the well path 2. An annulus 7 being filled more or less with a fluid and/or solids (not shown), for example cement residues, formation particles, precipitated drilling mud components and/or other casting materials or fluids, is located between the innermost casing 21 and a surrounding formation 9.

Figure 2:
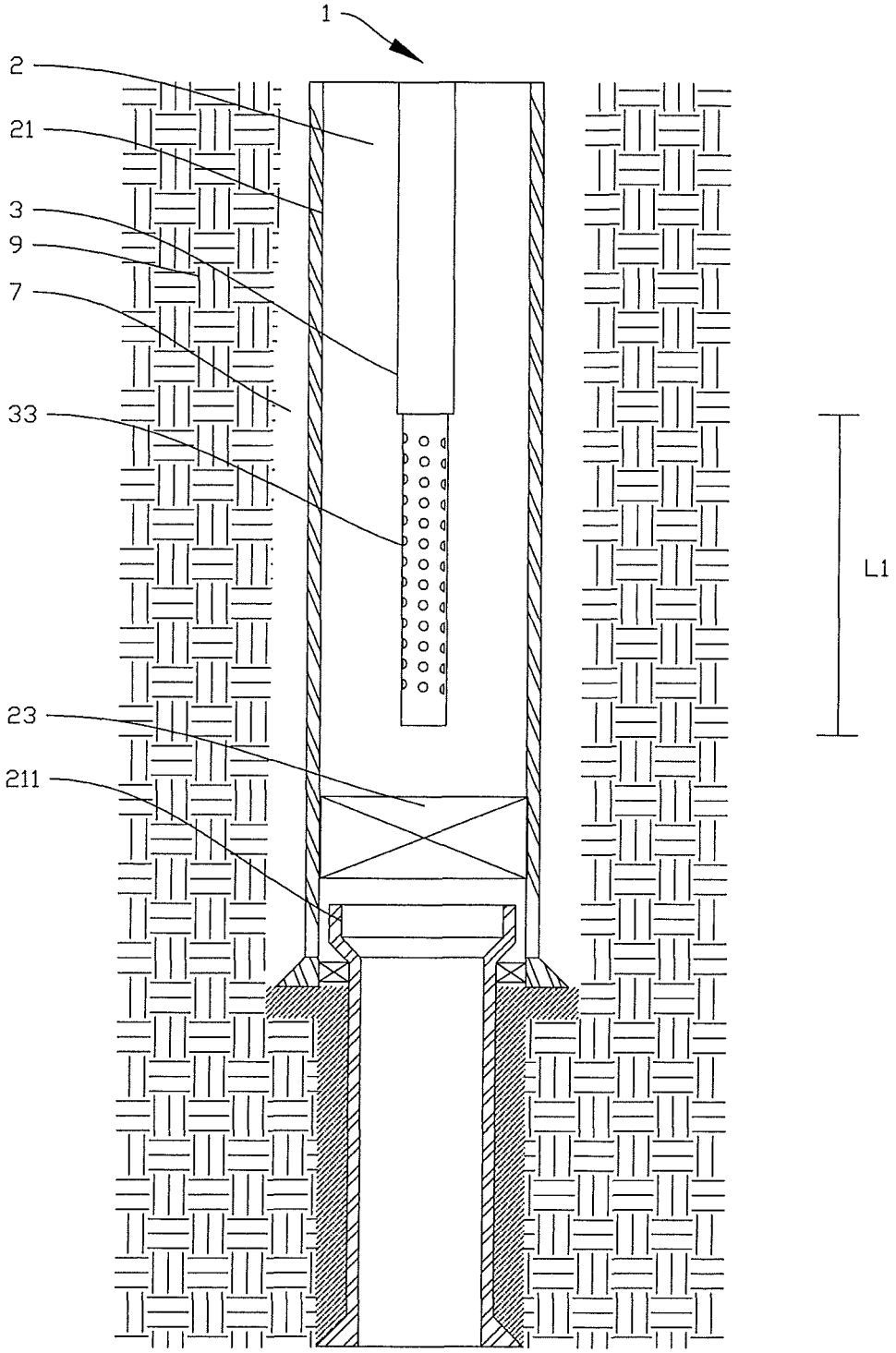
FIG. 2 shows the well after having set a plug base in the well and having lowered a pipe string into the well.

FIG. 2 shows the well 1 after having set a plug base 23 in the well 1, and after having lowered a perforation tool 33 into the innermost casing 21 on a pipe string 3. The perforation tool 33 is positioned above the plug base 23 and along a longitudinal section L1 of the well 1 within which plugging is desired.

Figure 3:
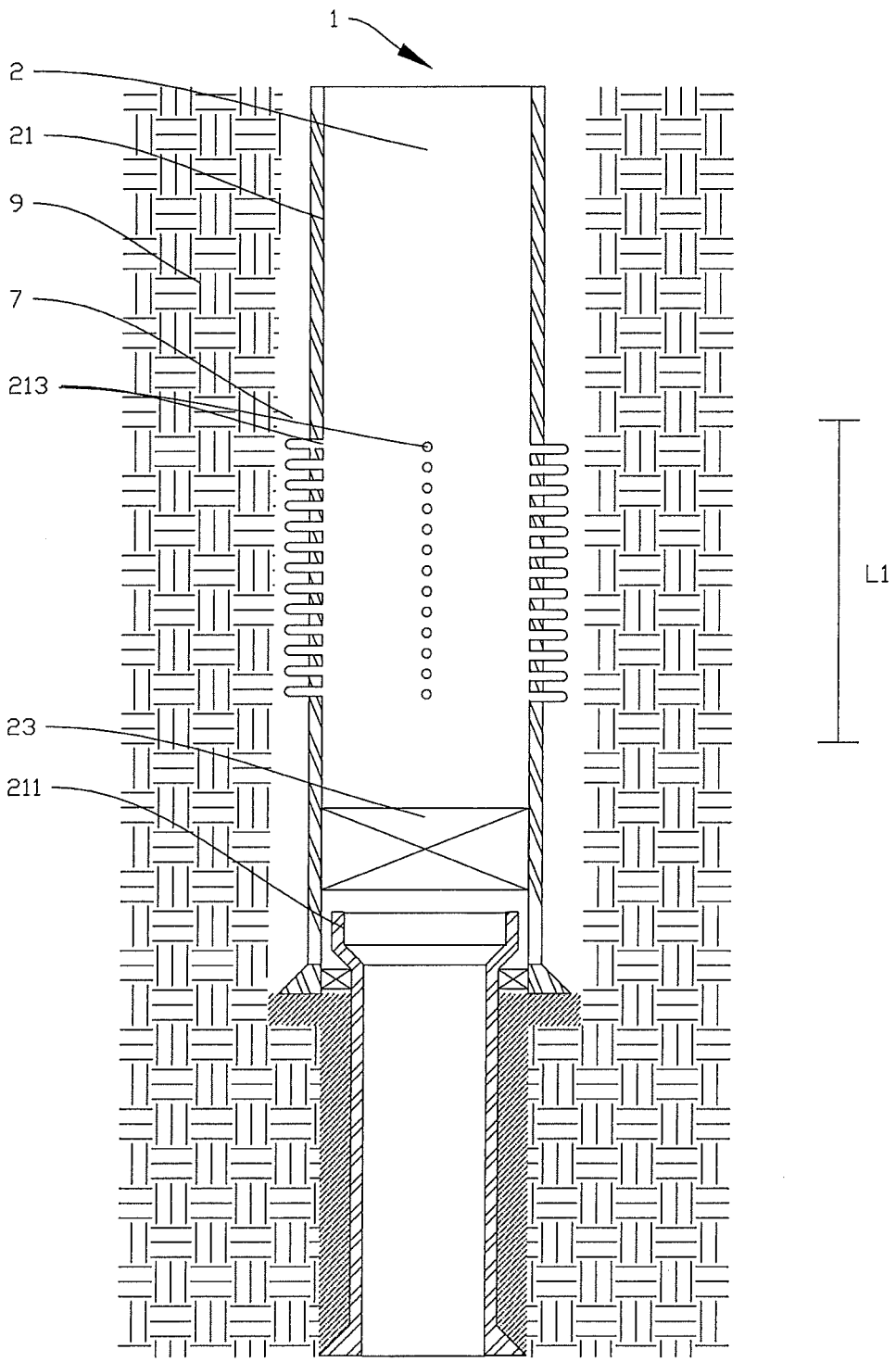
FIG. 3 shows the well after the perforation tool has formed holes in a casing (cf. the innermost casing)

FIG. 3 shows the well 1 after having formed several holes 213 in the innermost casing 21, and along the longitudinal section L1, by means of the perforation tool 33.

Figure 4:
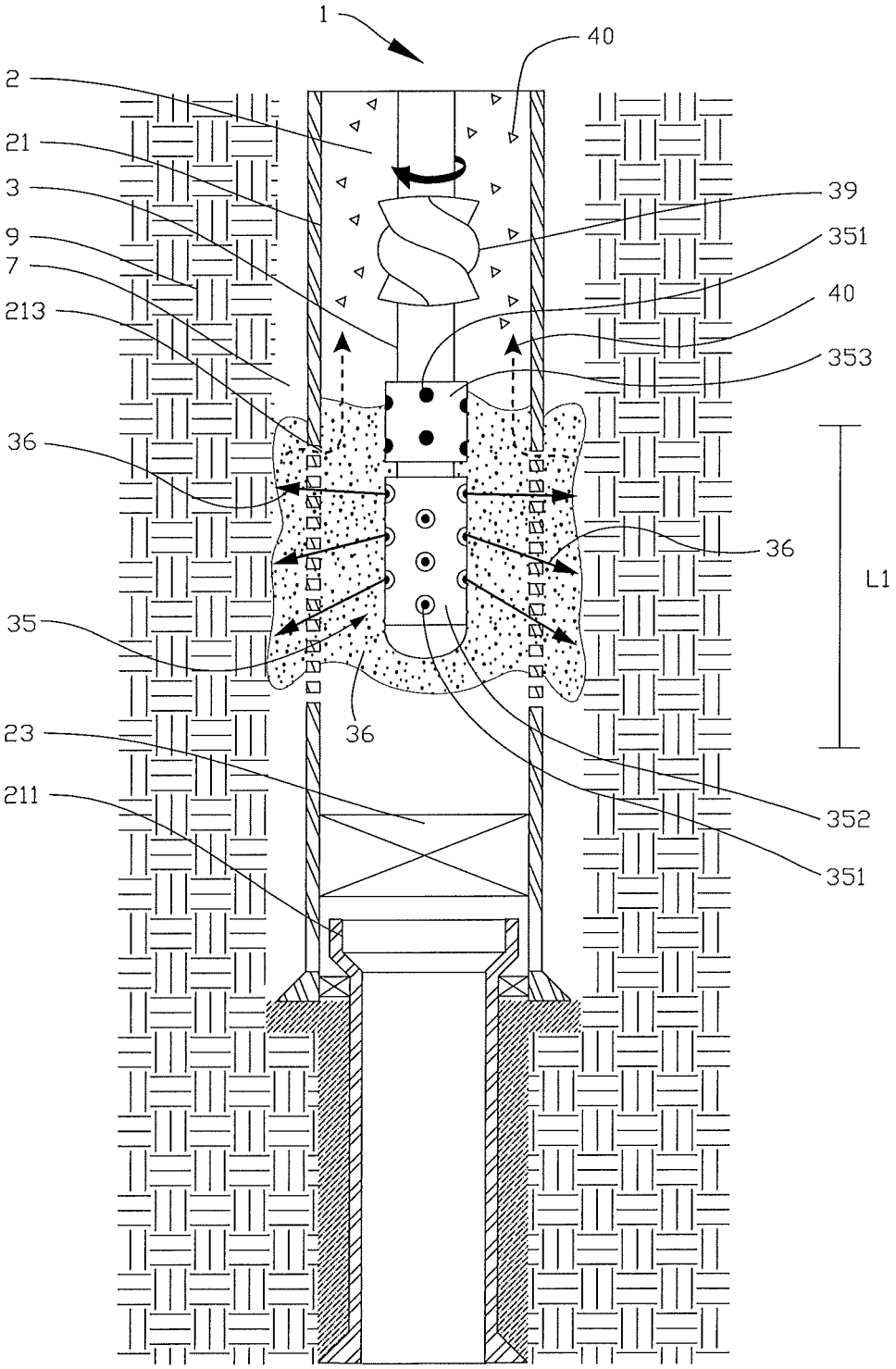
FIG. 4 shows the well after having lowered a flushing tool into the well and being in the process of flushing the casing and an external annulus via the holes in the casing.

FIG. 4 shows a flushing tool 35 subsequently being lowered into the innermost casing 21 on a pipe string 3. In this exemplary embodiment of the method, perforation is carried out in one trip down into the well 1 (cf. FIG. 2), whereas flushing and plugging are carried out in a separate trip down into the well 1. However, perforation as well as flushing and plugging may be carried out in one and the same trip down into the well 1, which is not shown herein.

FIG. 4 also shows a flushing fluid 36, for example drilling mud, being pumped down through the pipe string 3, out through several flow-through outlets 351 in the flushing tool 35 and into the innermost casing 21 and further out into the annulus 7 via holes 213 in the casing 21. By so doing, both the casing 21 and the annulus 7 are cleaned. The discharge jets of the flushing fluid 36 from the flushing tool 35, and its subsequent flow direction, is indicated with arrows in FIG. 4. The flushing fluid 36 discharges at high velocity from various outlets 351 in a first (and lower) section 352 of the flushing tool 35. Before initiating the discharge, a first ball (not shown) is dropped down through the pipe string 3 so as to seat in a first seat (not shown) disposed below the outlets 351 in the first section 352 of the flushing tool 35. This ensures that the flushing fluid 36 is forced out through these outlets 351. Further, the outlets 351 typically will be provided with nozzles in order to concentrate the discharge jets and achieve the desired concentration of the flushing fluid 36. The discharge jets from the outlets 351 possibly may be rotation-free. Also, the various outlets 351 are angled in such a manner that the discharge jets have dissimilar discharge angles relative to a plane being perpendicular to a longitudinal axis of the flushing tool 35. This is indicated in FIG. 4, too. The angled discharge jets render possible to gain access to, and clean effectively within, the annulus 7 between the innermost casing 21 and the surrounding formation 9. FIG. 4 also shows liberated particles 40 flowing, together with the flushing fluid 36, upwards in the casing 21 upon having been flushed and liberated in the annulus 7, subsequently flowing into the casing 21 via holes 213 therein. A curved arrow at an upper portion of the pipe string 3 indicates that the flushing tool 35 rotates along with the pipe string 3 whilst flushing. As an addition or alternative, the pipe string 3 may be moved in a reciprocating motion whilst flushing. Such motions ensure an even more thorough and more effective flushing and cleaning of the casing 21 and the annulus 7. The flushing also ensures better adhesion for a subsequent plugging material, which in this exemplary embodiment is comprised of cement slurry 37.

Figure 5:
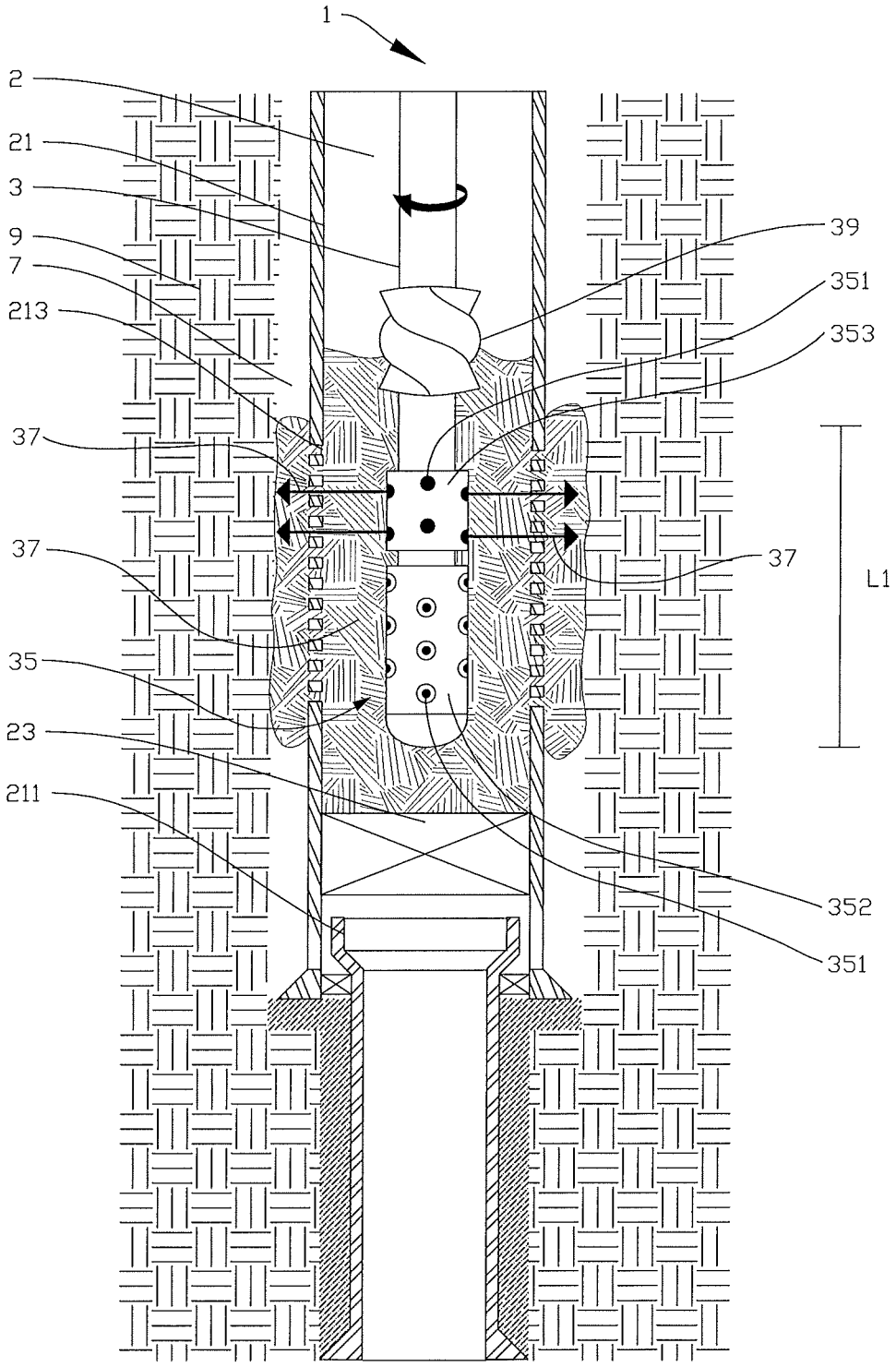
FIG. 5 shows the well after the flushing tool has completed the flushing and is in the process of displacing and distributing cement slurry (fluidized plugging material) in the casing and out into the external annulus via the holes in the casing.

FIG. 5 shows said cement slurry 37 when subsequently being pumped down through the pipe string 3 and out through the flushing tool 35, into the innermost casing 21 and further out into the annulus 7 via holes 213 in the casing 21. By so doing, cement slurry 37 is placed above the plug base 23, and along the longitudinal section L1 of the well 1. The cement slurry 37 is now discharging from various outlets 351 in a second (and upper) section 353 of the flushing tool 35. Before initiating the discharge, a second and larger ball (not shown) is dropped down through the pipe string 3 so as to seat in a second and larger seat (not shown) disposed immediately below the outlets 351 in the second section 353 of the flushing tool 35. This ensures that the cement slurry 37 is forced out through the outlets 351 in the second section 353 of the flushing tool 35. Activation by means of such balls constitutes prior art. Also in FIG. 5, a curved arrow at the upper portion of the pipe string 3 indicates that the flushing tool 35 rotates along with the pipe string 3 whilst pumping cement slurry 37. As an addition or alternative, the pipe string 3 may be moved in a reciprocating motion whilst pumping cement slurry 37. Such motions ensure that the cement slurry 37 is displaced out into the particular places in the innermost casing 21 and further out into the annulus 7. In this exemplary embodiment, the pipe string 3 is also provided with a helical displacement body 39 being rotated and moved in the cement slurry 37 in the casing 21 to further displace and distribute the cement slurry 37 in the casing 21 and further out into the annulus 7. This ensures an even more thorough and more effective cementing of the casing 21 and the annulus 7. As mentioned, such a displacement body (apparatus) is shown and described, among other places, in Norwegian patent application No. 20120099 and in the corresponding international publication WO 2012/128644 A2.

Figure 6:
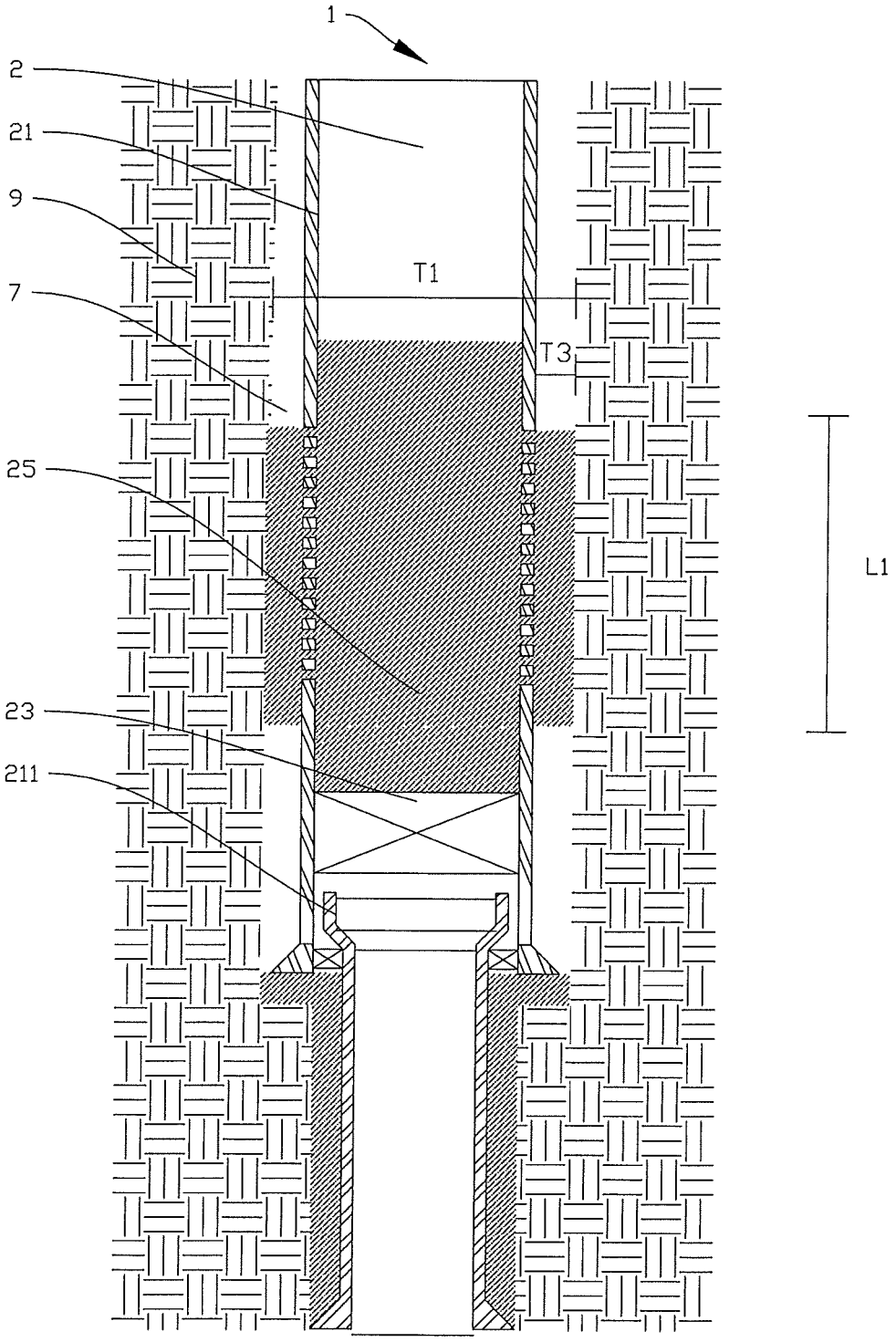
FIG. 6 shows the well after having set a plug in the well.

FIG. 6 shows the cement slurry 37 after having cured and set in the well 1 so as to form a plug 25. The plug 25 covers substantially a complete cross section T1 of the well 1.

Figure 7:
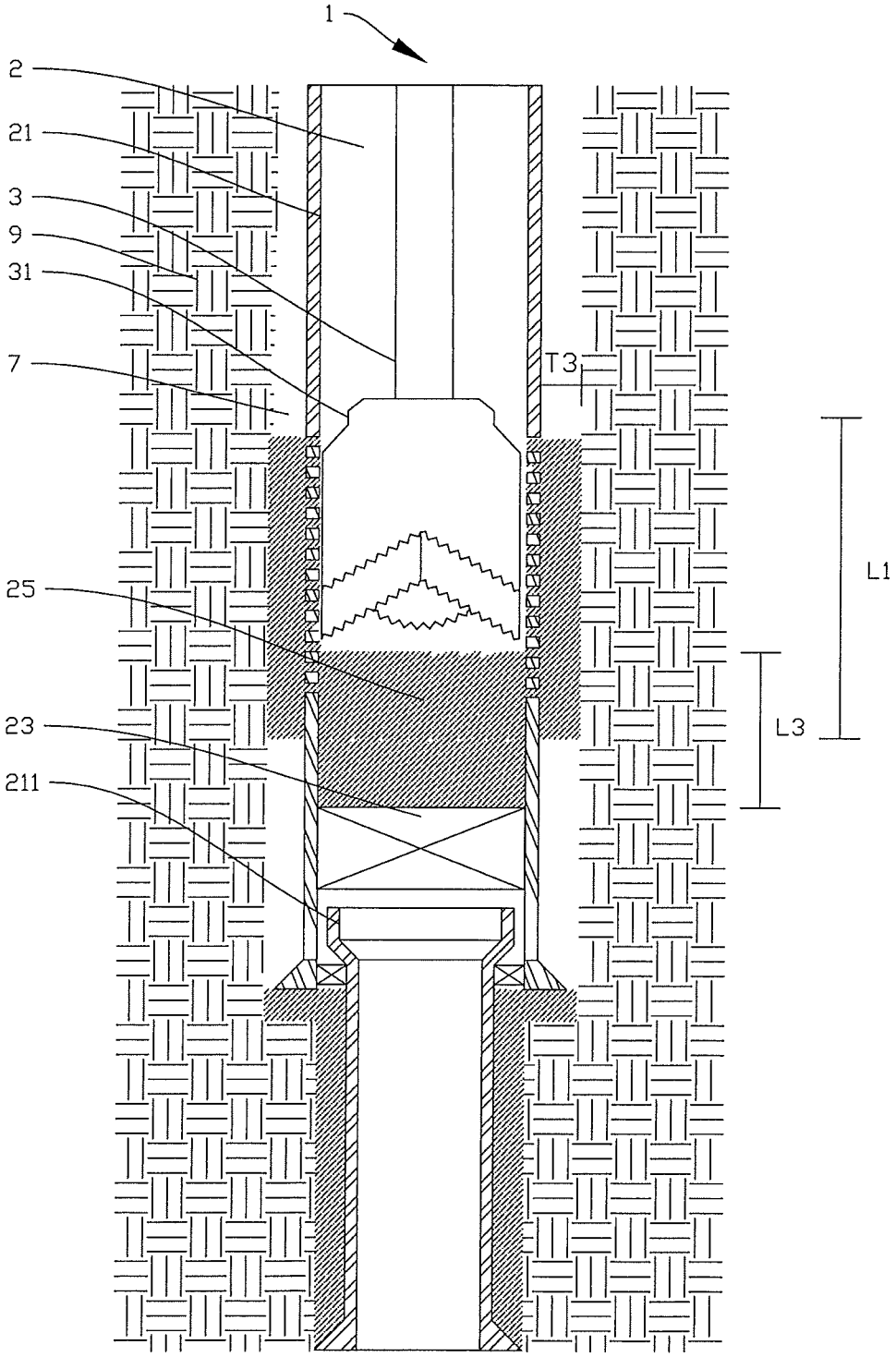
FIG. 7 shows the well immediately after having drilled away a portion of the plug.

FIG. 7 shows the well 1 immediately after having drilled away a portion of the plug 25 in the innermost casing 21 by means of a drilling tool 31. After the drilling, a cross-sectional section T3 of the plug 25 remains in the annulus 7, whereas a longitudinal section L3 of the plug 25 remains at the bottom thereof, and against the plug base 23. The remaining longitudinal section L3 constitutes ca. ⅓ of the original length of the plug 25.

Figure 8:
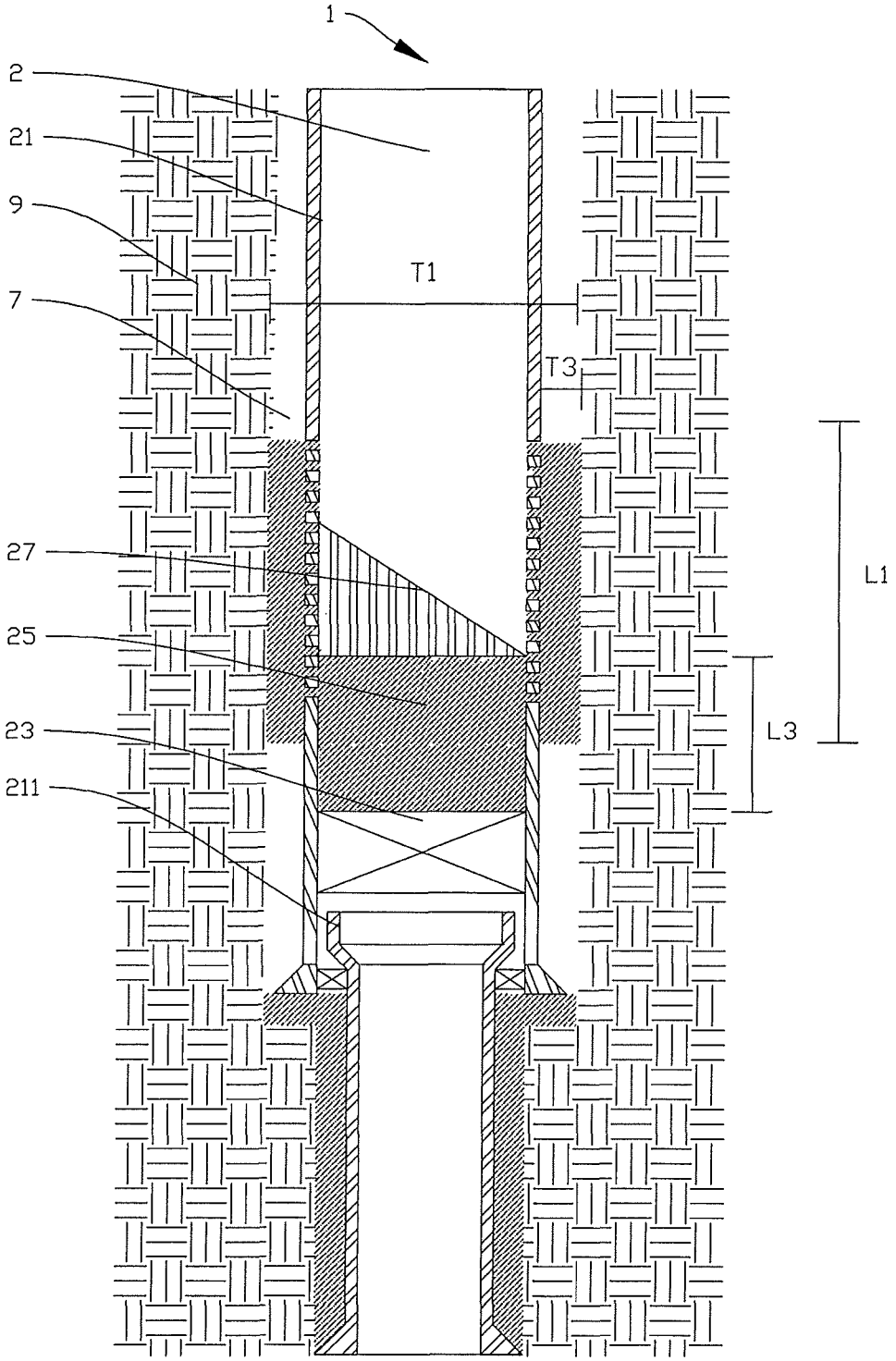
FIG. 8 shows the well after having inserted a direction-guiding element (whipstock) into the well.

FIG. 8 shows the well 1 after having inserted a direction-guiding element 27, in the form of a whipstock, into the innermost casing 21 and having placed it on top of the remaining longitudinal section L3 of the plug 25.

Figure 9:
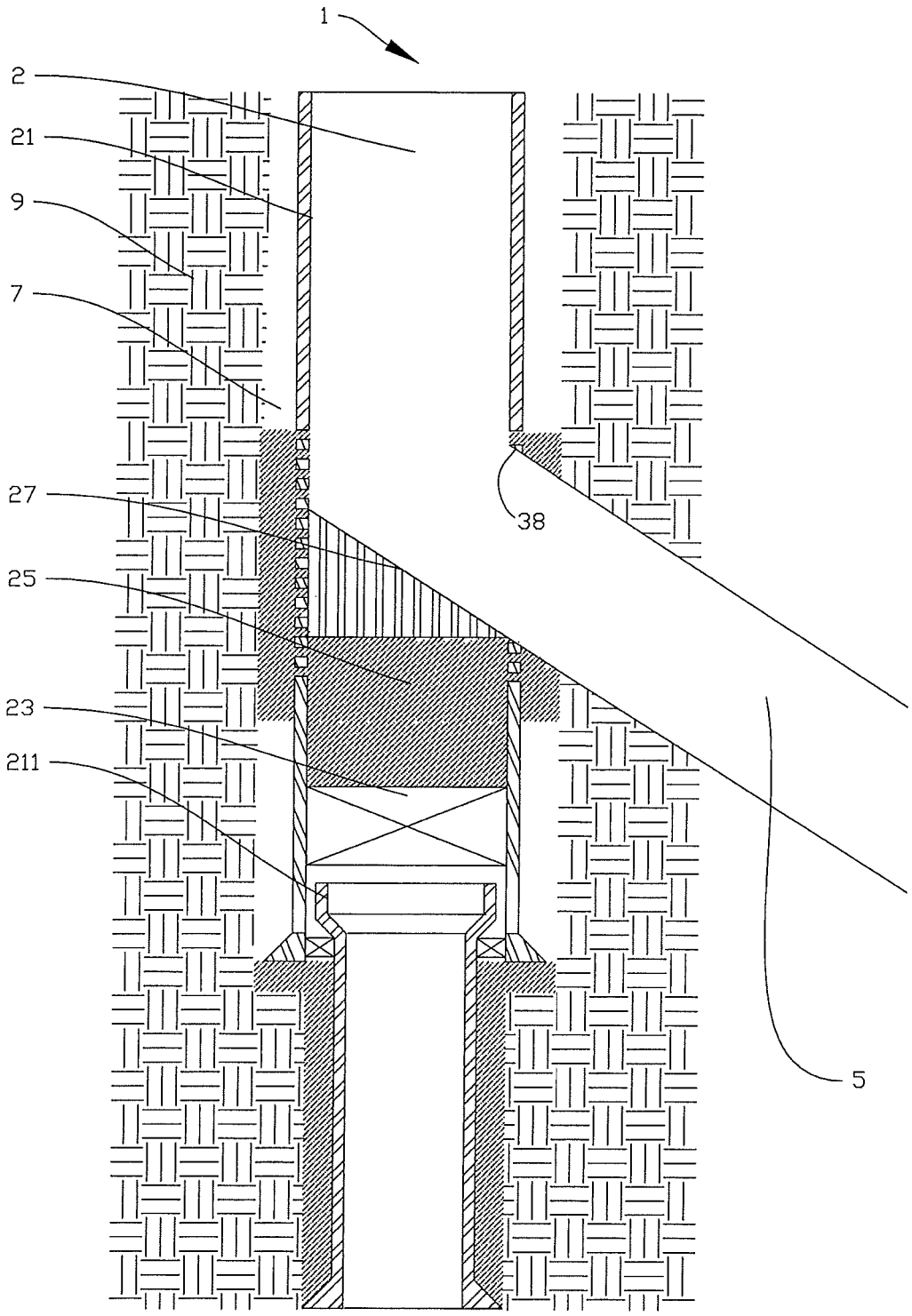
FIG. 9 shows the well after having drilled an exit hole (window) through the casing and having drilled a new well path out from the exit hole in the well.

FIG. 9 shows the well 1 after said drilling tool 31 (not shown in FIG. 9) has drilled through the casing 21 and the remaining cross-sectional section T3, and then in a direction given by the geometric shape of the direction-guiding element 27. In this manner, an exit hole 38 (window) is formed from the well 1. The drilling tool 31 drills further into the formation 9, thus drilling out a new well path 5 from the well 1.

The invention claimed is:

1. A method for establishment of a new well path from an existing well wherein the existing well, at least in a portion where the new well path is to be established, is defined radially by at least one casing, wherein the method comprises:

(A) disposing and anchoring a plug base in an innermost casing in the well;

(B) lowering a perforation tool into the innermost casing, and onto a longitudinal section of the well located above the plug base;

(C) with the perforation tool, forming holes in the at least one casing along the longitudinal section of the well;

(D) with a flushing tool attached to a lower portion of a flow-through pipe string, and lowered into the innermost casing onto the longitudinal section, pumping a flushing fluid down through the pipe string, out through at least one flow-through outlet in the flushing tool, into the innermost casing and further out, via holes in the at least one casing, into at least one annulus located outside the innermost casing, thereby cleaning the at least one annulus;

(E) pumping a fluidized plugging material down through the pipe string and out through the flushing tool, into the innermost casing and further out into the at least one annulus via holes in the at least one casing;

(F) placing the fluidized plugging material above the plug base, and along the longitudinal section of the well, after which the plugging material forms a plug covering substantially a complete cross section of the well, wherein at least one of the at least one outlet in the flushing tool is angled non-perpendicularly relative to a longitudinal axis of the flushing tool, whereby a corresponding discharge jet from the flushing tool also will be non-perpendicular to the longitudinal axis of the flushing tool;

(G) removing a portion of the plug in such a manner that at least a cross-sectional section of the plug remains in the at least one annulus at the outside of the at least one casing;

(H) disposing and anchoring a direction-guiding element in the innermost casing, and at least partially within the longitudinal section of the well;

(I) with the direction-guiding element, guiding a drilling tool against the inside of the innermost casing, and in direction of the new well path to be established; and (J) with the drilling tool, and within the longitudinal section, forming an exit hole through the at least one casing and the cross-sectional section of the plug, thereby opening up to subsequent formation of said new well path exiting from the well.

2. The method according to claim 1, wherein the at least one casing comprises only the innermost casing.

3. The method according to claim 1, wherein the at least one casing comprises a pipe-in-pipe assembly composed of at least two casing sizes, wherein the innermost casing constitutes the smallest casing size in the pipe-in-pipe assembly.

4. The method according to claim 1, wherein the flushing tool comprises a first section for discharge of the flushing fluid, and a second section for discharge of the fluidized plugging material.

5. The method according to claim 1, wherein the flushing tool is formed with several outlets, and wherein the outlets are angled within ±80° of a plane being perpendicular to the longitudinal axis of the flushing tool, whereby the discharge jets from the longitudinal axis of the flushing tool also are distributed within ±80° of said plane.

6. The method according to claim 1, wherein at least one of the at least one outlet in the flushing tool is provided with a nozzle.

7. The method according to claim 1, wherein step (D) comprises rotating the pipe string whilst flushing.

8. The method according to claim 1, wherein step (D) comprises moving the pipe string in a reciprocating motion whilst flushing.

9. The method according to claim 1, further comprising, before step (D), adding an abrasive agent to the flushing fluid.

10. The method according to claim 9, further comprising adding an abrasive agent to the flushing fluid in an amount corresponding to between 0.05 weight percent and 1.00 weight percent.

11. The method according to claim 9, wherein the abrasive agent comprises sand particles.

12. The method according to claim 1, further comprising discharging the flushing fluid from the at least one outlet of the flushing tool at a discharge velocity of at least 15 meters per second.

13. The method according to claim 12, further comprising discharging the flushing fluid from the at least one outlet of the flushing tool at a discharge velocity of at least 50 meters per second.

14. The method according to claim 1, further comprising discharging the flushing fluid from the at least one outlet of the flushing tool as a substantially rotation-free discharge jet.

15. The method according to claim 1, wherein the fluidized plugging material comprises cement slurry.

16. The method according to claim 1, wherein the fluidized plugging material comprises a fluidized particulate mass.

17. The method according to claim 1, wherein the flushing fluid comprises drilling mud.

18. The method according to claim 1, further comprising using a displacement body to further displace and distribute the fluidized plugging material in the innermost casing and further out into the at least one annulus.

19. The method according to claim 1, further comprising, before step (B):

connecting the perforation tool and the flushing tool into an assembly thereof; and connecting the assembly to said lower portion of the pipe string;

thereby carrying out steps (B, C) and step (D) in one trip down into the well.

20. The method according to claim 19, further comprising releasably connecting a lower end portion of the flushing tool to the perforation tool; and separating the perforation tool from the flushing tool and leaving it in the well after step (C).

21. The method according to claim 1, further comprising, before step (D):

lowering the perforation tool into the innermost casing and forming said holes in the at least one casing along the longitudinal section of the well;

pulling the perforation tool out of the well; and attaching the flushing tool to the lower portion of the pipe string for subsequent execution of steps (D)-(F);

thereby carrying out the perforation steps (B, C) and the flushing step (D) in separate trips down into the well.

22. The method according to claim 1, wherein step (G) further comprises removing a portion of the plug in the innermost casing, and in such a manner that a longitudinal section of the plug still remains centrally in the well and within the innermost casing.

23. The method according to claim 22, wherein the longitudinal section remaining centrally in the well constitutes less than half of the original length of the plug.

24. The method according to claim 1, wherein step (G) further comprises removing the portion of the plug by drilling away the portion.

25. The method according to claim 1, further comprising, after step (J), drilling out the new well path from the exit hole through the at least one casing in the well.

* * * * *